US007948368B2

(12) United States Patent
Huber

(10) Patent No.: US 7,948,368 B2
(45) Date of Patent: May 24, 2011

(54) METHOD FOR EVACUATING BUILDINGS DIVIDED INTO SECTIONS

(75) Inventor: Andreas Huber, Schaffhausen (CH)

(73) Assignee: Siemens Aktiengesellschaft, Munich (DE)

( * ) Notice: Subject to any disclaimer, the term of this patent is extended or adjusted under 35 U.S.C. 154(b) by 410 days.

(21) Appl. No.: 12/281,456

(22) PCT Filed: Feb. 1, 2007

(86) PCT No.: PCT/EP2007/050978

§ 371 (c)(1),
(2), (4) Date: Sep. 2, 2008

(87) PCT Pub. No.: WO2007/099015

PCT Pub. Date: Sep. 7, 2007

(65) Prior Publication Data

US 2009/0040038 A1 Feb. 12, 2009

(30) Foreign Application Priority Data

Mar. 1, 2006 (EP) ..... 06110555

(51) Int. Cl.

| | |
|---|---|
| ***G08B 29/00*** | (2006.01) |
| ***G08B 5/00*** | (2006.01) |
| ***H05B 39/00*** | (2006.01) |

(52) U.S. Cl. ..... 340/506; 340/540; 340/331; 340/332; 340/286.01

(58) Field of Classification Search ..... 340/506
See application file for complete search history.

(56) References Cited

U.S. PATENT DOCUMENTS

| | | | | |
|---|---|---|---|---|
| 6,317,042 | B1 | 11/2001 | Engelhorn et al. | |
| 6,496,110 | B2 * | 12/2002 | Peterson et al. | 340/522 |
| 6,809,642 | B1 * | 10/2004 | Brenner | 340/506 |
| 2004/0036579 | A1 | 2/2004 | Megerle | |

FOREIGN PATENT DOCUMENTS

| | | | |
|---|---|---|---|
| CA | 2018125 | A1 | 12/1990 |
| EP | 0401038 | A1 | 12/1990 |

* cited by examiner

*Primary Examiner* — Donnie L Crosland
(74) *Attorney, Agent, or Firm* — Laurence A. Greenberg; Werner H. Stemer; Ralph E. Locher

(57) ABSTRACT

A method, evacuation system and hazard warning center for the evacuation of a building divided into sections by the hazard warning center, which is connected to at least one hazard warning unit detecting a hazard. The hazard warning center produces an evacuation plan for the sections of the building on the basis of the location of the hazard detected by the hazard warning unit, the data received in connection with the hazard and at least one stored condition, and at least one alarm signaling unit in a section is sent at least one request to emit either a warning signal or an evacuation signal on the basis of the evacuation plan.

17 Claims, 2 Drawing Sheets

Figure 1:
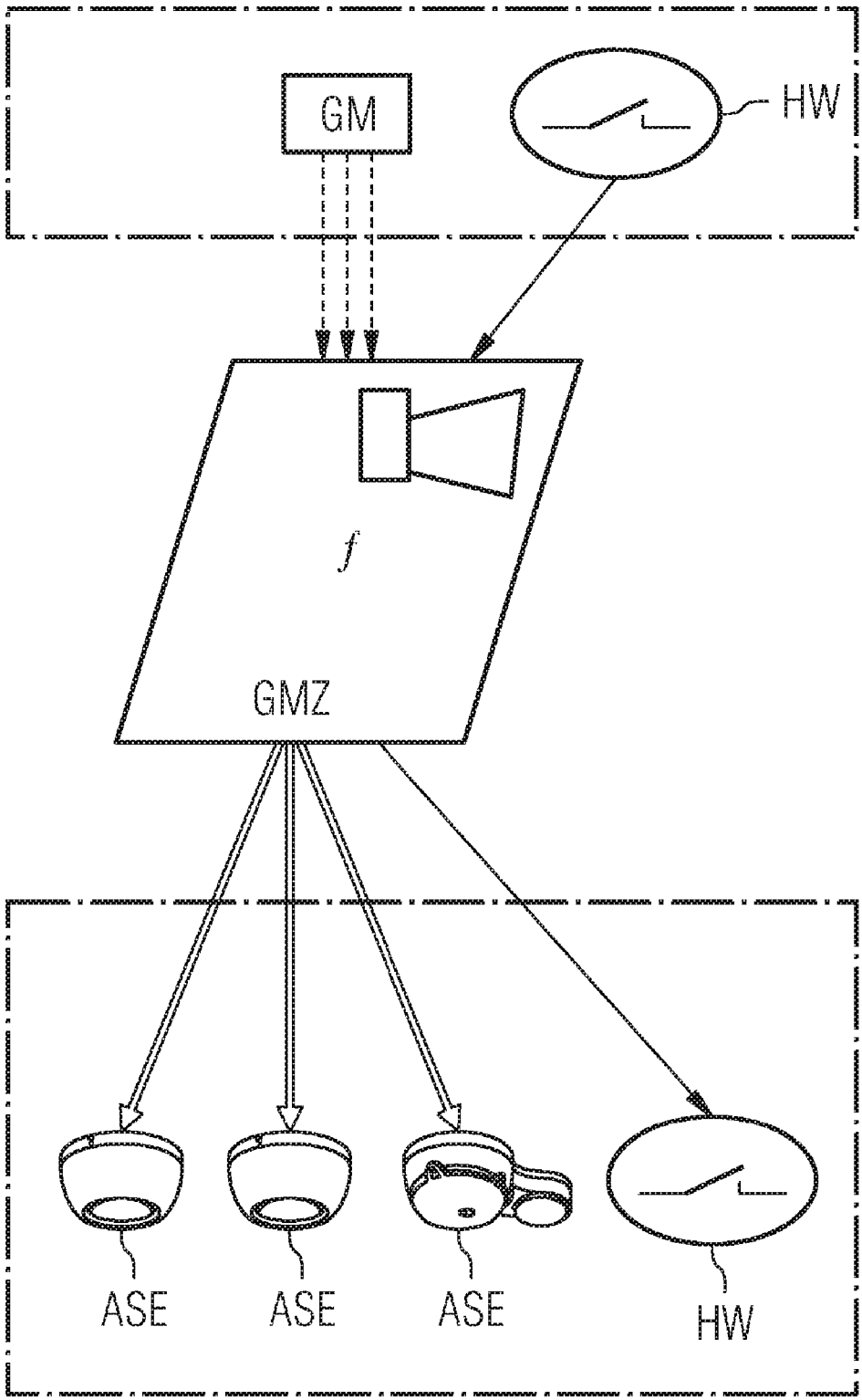

| Warning signal | Delay/min. | Priority |
|---|---|---|
| Entire building | 0 | Warning |

| Evacuation signal | Delay/min. | Priority |
|---|---|---|
| Basement | 0 | Evac. |
| First floor | 15 | Evac. |
| Second floor | 10 | Evac. |
| Third floor | 5 | Evac. |
| Fourth floor | 0 | Evac. |
| Fifth floor | 0 | Evac. |
| Sixth floor | 5 | Evac. |
| Seventh floor | 10 | Evac. |
| Eighth floor | 15 | Evac. |
| Ninth floor | 20 | Evac. |
| Roof | 0 | Evac. |

METHOD FOR EVACUATING BUILDINGS DIVIDED INTO SECTIONS

BACKGROUND OF THE INVENTION

Field of the Invention

The invention relates to a method, to a hazard warning center and to an evacuation system for evacuating a building divided into sections by means of a hazard warning center which is connected to at least one hazard warning unit which detects a hazard.

The term evacuation relates to the movement of people away from the location of a hazard, for example the clearing of an apartment, a house etc. The evacuation time is generally referred to as the evacuation duration.

EP 401038 A1 describes an emergency evacuation arrangement containing a plurality of sensors for monitoring a hazard, such as smoke, fire or a tremor, in a respective area of a building. The arrangement has a processor which receives the signals generated by the sensors. The processor generates alarm warning signals and the signals which indicate escape routes. The driving of optical and acoustic indication means by the processor signals is used to indicate a safe escape route.

US 2004/0036579 A1 describes an evacuation system, which can be adapted, for buildings to be evacuated. The system has controllers which determine the exits which ensure safe exit in the event of a hazardous situation. Signaling means which indicate the safe exits are also provided.

U.S. Pat. No. 6,317,042 B1 describes how an evacuation route is determined by an emergency server on the basis of the location and position of the sensor which determines the hazardous situation. The evacuation route is displayed on a display device, for instance a monitor, situated in each room. In the event of a change in the hazardous situation, a corresponding changed evacuation route is displayed on the monitors in the rooms.

Events, for example industrial accidents, fires, bomb threats, terrorist attacks, gas alarms etc., may make it possible for a building to have to be evacuated. The individual strategy when evacuating buildings was examined, inter alia, by John Abrahams in his book "*Fire escape in difficult circumstances*, chapter 6, in: Stollard, 1994, *Design against fire*". In this case, the independent variables are formed by the complexity of the building and the mobility of the people (physical capacity, limp etc.) and the dependent variable is the strategy. With decreasing mobility and increasing complexity of the building, the strategy changes from "rapid departure", via "slow departure" and "movement to a safe location" (for example a stairwell), to "stay at the location and wait for rescue". This last strategy applies, in particular, to bedridden people (for example when evacuating hospitals) who have to be rescued by nursing staff or rescue workers. So-called evacuation plans are used for evacuation. Evacuation plans deal with the procedure, that is to say are part of the preventive, organizational (non-structural, operational) fire protection. Preventive fire protection is the umbrella term for all measures which prevent or restrict the occurrence, spreading and effect of fires in advance. Since a statement relating to the location of a possible hazard in a building can be made only with great difficulty in advance, such evacuation plans are suboptimal since they can ensure efficient clearing of a building only to a limited extent.

So-called hazard warning systems, for example warning systems for fire, gas, temperature etc., which usually comprise detectors which are connected to a center are used in buildings to detect hazards. Such hazard warning systems are used in public buildings, office buildings, hotels, industrial buildings, airports, train stations, workshops, schools etc. If an alarm or hazard is triggered at one of the detectors or hazard warning units, the hazard warning center is notified. The functions of the center can be freely parameterized and support an alarm organization adapted to the object to be monitored. Such centers usually have an integrated operating part having a graphical display, which can display text, characters etc., and interfaces to communication networks.

BRIEF SUMMARY OF THE INVENTION

The object of the present invention can be seen to be that of proposing an efficient and cost-effective solution for dynamic evacuation from a building.

According to the invention, the object is respectively achieved by means of the subject matters of the independent patent claims.

Developments of the invention are specified in the subclaims.

A core idea of the invention can be seen in the fact that, in order to evacuate a building divided into sections, use is made of a hazard warning center which is connected to at least one hazard warning unit which detects a hazard. A section is to be understood as meaning a floor, part of a floor, a building, part of a building, a section of a building or building complex. According to the location of the hazard detected by the hazard warning unit, the received data relating to the hazard and at least one stored condition, the hazard warning center creates an evacuation plan for the sections of the building. An evacuation plan is understood as meaning, for example, the chronological sequence of an evacuation. A request to emit either a warning signal or an evacuation signal is then sent to at least one alarm signaling unit in a section on the basis of the evacuation plan. This request may be, for example, a signaling message of a communication network. This type of dynamic evacuation constitutes a functionality for the temporally staggered driving of alarm signaling units. The processing and evaluation of the data and the creation of the evacuation plan take place individually and thus result in optimum and safe clearing of the building. During signaling, use is made, in principle, of two successive phases or types of alarm, namely a warning signal and an evacuation signal. It goes without saying that, according to the invention, further signals, for example an indication of escape routes in the form of, for example, an announcement, a graphical display etc. and the combination thereof, could also be used. Different triggering conditions may be configured for both types of signaling. These conditions are generally stored in the hazard warning center in the form of a table, a database etc. The delay time, usually in minutes, for triggering the warning signal or the evacuation signal can be used, for example, as a condition. A further condition could be that the changeover from the warning signal to the evacuation signal in a section is defined. In this case, the delay time may be made dependent on the location of the hazard. The defined triggering conditions are respectively ORed (separately in each case for the warning signal and the evacuation signal), that is to say triggering takes place when at least one of the defined conditions has been satisfied. A priority may be assigned to both the evacuation signal and the warning signal. In this case, the evacuation signal is usually assigned a higher priority and is accordingly given priority over the warning signal when conditions for both signals are satisfied at the same time. Alarm signaling units which, depending on the type, are able to become active only in the case of a warning signal or an evacuation signal or when changing over to the runtime are connected to the hazard warning center. As a result, it is possible to use all conventional alarm devices, for example conventional horns with sound sequences which can be set on the horn, horns whose sound sequences can be changed using a computer program, horns with sound sequences which can be configured using software and with changeover to the runtime, announcement units, for instance loudspeakers etc., alarm bells, flash lamps, luminous strips etc. The communication network can also be used to drive computers and telephones in such a manner that they output a warning or evacuation signal. It goes without saying that door opener systems, monitoring cameras etc. could also be used for safe evacuation. An evacuation plan is created and controlled in a fully automatic manner in the event of a hazard. However, if necessary, a manual interruption may take place. The interruption may be effected in the hazard warning center directly or in a connected operating part.

A great advantage of the invention is that an optimum evacuation plan can be dynamically created on the basis of the location of the hazard. This means that a safe escape route which leads away from the location of the hazard can be signaled to the people in the building. In addition, the use of conditions makes it possible to largely avoid congestion, for example at doors, in stairwells etc., and panic of the people affected in the building.

The invention is explained in more detail using an exemplary embodiment which is illustrated in a figure, in which:

BRIEF DESCRIPTION OF THE SEVERSL VIEWS OF THE DRAWING

Figures 2, 3:
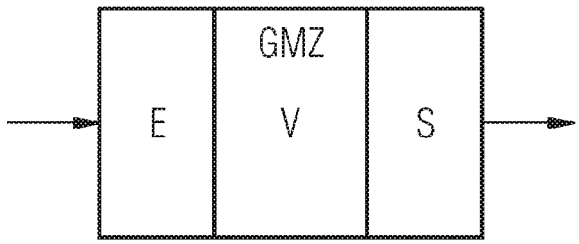

FIG. 1 shows a simplified illustration of an evacuation system according to the invention, FIG. 2 shows a typical evacuation plan for a detected hazard on the fourth floor, FIG. 3 shows a hazard warning center according to the invention.

DESCRIPTION OF THE INVENTION

FIG. 1 shows a simplified illustration of an evacuation system according to the invention in a building. A hazard warning unit GM, for example in a room in a section, detects a hazard, for example a fire, and relays this hazard to the hazard warning center GMZ. Further units HW of the building can transmit parameters to the hazard warning center GMZ, for example by means of digital inputs of the hazard warning center, in order to evaluate the hazard. The evacuation plan can also be manually controlled or stopped using such digital inputs. The hazard warning center GMZ evaluates the data which are received from the hazard warning unit GM and relate to the hazard and creates an evacuation plan for the multistory building on the basis of the location of the hazard and at least one condition stored in the hazard warning center GMZ. This makes it possible to produce an evacuation plan which is individually adapted to the hazard, and it is thus possible to evacuate the people in the building in a quick and efficient manner and largely without panic. In order to implement the evacuation plan, the hazard warning center GMZ transmits requests to emit a signal to at least one alarm signaling unit ASE in a section. Such requests may generally be signaling messages of a communication network. The signaling messages to be used depend on the network protocol used and can generally be selected as desired. The at least one alarm signaling unit ASE now receives at least one request to emit a warning signal or an evacuation signal. It goes without saying that it is conceivable, according to the invention, to use further signals, that is to say sound sequences, for alarm signaling. Alarm signaling units, such as announcement units, graphical displays, luminous strips etc., may likewise receive a request to signal the hazard and to control the evacuation from the hazard warning center GMZ. Even door opener systems, monitoring cameras and other units HW may be used to control the evacuation. Such possibilities are stored as conditions in the hazard warning center GMZ. In this case, a table, a database or the like is usually used as the storage unit. The delay time for emitting a warning signal or an evacuation signal in a section may be defined as a further condition. In this case, the delay time may depend on the distance from the location of the hazard. The delay time for changeover, that is to say for changing from the warning signal to the evacuation signal, may also be defined thereby. Yet a further condition could be that a priority and an associated rule are assigned to the individual signals. Should, for example, an alarm signaling unit ASE be requested to simultaneously emit both the warning signal and the evacuation signal, only the signal with the higher priority, for example the evacuation signal, could be emitted on the basis of the priority condition. It goes without saying that conditions regarding the type and scope of hazard may also be determined. As a result of the evacuation system, evacuation plans created by a hazard warning center on the basis of the location and further conditions may be carried out in a fully automatic manner in order to clear the building. However, in some situations, it may be expedient for the evacuation plan to be controlled or interrupted manually. For this purpose, it must be ensured that corresponding control or interruption can be carried out by a unit which is connected to the hazard warning center GMZ, for example an operating part, or in the hazard warning center GMZ itself.

FIG. 2 shows a typical evacuation plan for a detected hazard on the fourth floor. An evacuation plan is created in accordance with FIG. 1. The hazard warning center GMZ transmits a request to emit a warning signal with a delay time of 0 minutes, that is to say immediately, to each alarm signaling unit ASE in the entire building. In order to evacuate the individual sections, a changeover is effected from the warning signal to the evacuation signal. The changeover or change is effected on the floor with a time delay. The evacuation should be initiated immediately, that is to say with a delay time of 0 minutes, on the fourth and fifth floors, in the basement and on the top floor, for example. In contrast, the evacuation signal will only be sounded with a delay of 20 minutes on the ninth floor. This makes it possible to regulate and control the flow of fleeing people. In this example, it is assumed that the evacuation signal has a higher priority than the alarm signal. If the evacuation signal is thus intended to be emitted, the warning signal is switched off on the relevant floor.

FIG. 3 shows a hazard warning center GMZ according to the invention for carrying out the method according to FIG. 1. The hazard warning center GMZ has a receiving unit E, a processing unit V and a transmitting unit S.

The invention claimed is:

1. A method for evacuating a building divided into sections by way of a hazard warning center connected to at least one hazard warning unit detecting a hazard, the method which comprises:

generating an evacuation plan with the hazard warning center for a chronological sequence of evacuating the sections of the building on a basis of a location of the hazard detected by the hazard warning unit, received data relating to the hazard, and at least one stored condition; and transmitting at least one request to emit either a warning signal or an evacuation signal to at least one alarm signaling unit in a section of the building based on the evacuation plan.

2. The method according to claim 1, which comprises using a delay time for emitting the warning and evacuation signals in a section as at least one condition.

3. The method according to claim 1, which comprises using a delay time for changing over from the warning signal to the evacuation signal in a section as at least one condition.

4. The method according to claim 3, wherein the delay time is dependent on the location.

5. The method according to claim 2, wherein the delay time is dependent on the location.

6. The method according to claim 1, which comprises assigning a priority to both the evacuation signal and the warning signal as at least one condition.

7. The method according to claim 6, which comprises, if a request is received to simultaneously emit the warning signal and the evacuation signal, emitting the signal having the higher priority with the alarm signaling unit.

8. The method according to claim 1, wherein the alarm signaling unit is one or more units selected from the group consisting of an alarm horn, a flash lamp, a strobe, an alarm bell, an announcement unit, graphical displays, and luminous strips.

9. The method according to claim 8, wherein the alarm horn emits at least two different sound sequences.

10. The method according to claim 9, wherein the two different sound sequences correspond to a warning signal and to an evacuation signal, respectively.

11. The method according to claim 1, wherein the evacuation plan can be manually interrupted in the hazard warning center.

12. The method according to claim 11, wherein an operating unit connected to the hazard warning center may be used for the manual interruption.

13. The method according to claim 1, wherein the request is a signaling message of a communication network.

14. The method according to claim 1, which comprises using a request either to open or close a door and/or a request to monitor a region by means of a monitoring camera as at least one condition.

15. The method according to claim 1, wherein an evacuation plan is created on the basis of the at least one condition for the at least one alarm signaling unit in a section.

16. A hazard warning center for evacuating a building divided into sections if a hazard is detected by at least one detecting hazard warning unit connected to the hazard warning center, comprising:

a receiving unit for receiving data relating to the hazard detected by the hazard warning unit;

a processing unit connected to said receiving unit, said processing unit creating an evacuation plan for a chronological sequence of evacuating the sections of the building based on a location of the hazard detected by the hazard warning unit, the received data, and at least one stored condition;

a transmitting unit connected to said processing unit for transmitting at least one request to emit either a warning signal or an evacuation signal to at least one alarm signaling unit in a section of the building on a basis of the evacuation plan.

17. An evacuation system for a building divided into sections, the system comprising:

a hazard warning center;

one or more hazard detecting units disposed in the building and connected to said hazard warning center for transmitting data relating to a detected hazard to said hazard warning center;

said hazard warning center, upon receiving a signal indicating a detected hazard, creating a plan for a chronological sequence of evacuating the sections of the building on the basis of a location of the hazard detected by a respective said hazard detecting unit, the received data, and at least one stored condition; and at least one alarm signaling unit connected to said hazard warning center for emitting a request to emit either a warning signal or an evacuation signal on the basis of the evacuation plan in a section of the building.

* * * * *